US005804886A

United States Patent [19]

Danielson et al.

[11] Patent Number: 5,804,886

[45] Date of Patent: Sep. 8, 1998

[54] ELECTRONIC SWITCH WITH INSERT MOLDING AND METHOD OF MANUFACTURING SAME

[75] Inventors: David J. Danielson, Hamilton; Charles R. Griffin, Carthage, both of Ill.; Rajkumar Ramamurthy, Keokuk, Iowa

[73] Assignee: Methode Electronics, Inc., Chicago, Ill.

[21] Appl. No.: 745,426

[22] Filed: Nov. 12, 1996

[51] Int. Cl.[6] ..... H01H 11/00

[52] U.S. Cl. ..... 307/10.1; 29/622

[58] Field of Search ..... 307/9.1–10.6; 200/11 D, 11 DA; 361/781, 832; 29/33 M, 622, 882, 883; 264/155, 163; 439/83, 79; 338/184, 199, 200

[56] References Cited

U.S. PATENT DOCUMENTS

| | | | |
|---|---|---|---|
| 4,297,671 | 10/1981 | Flanders | 338/200 |
| 4,379,955 | 4/1983 | Comerford | 200/11 DA |
| 4,668,033 | 5/1987 | Reichardt | 439/83 |
| 5,412,371 | 5/1995 | Kaplan | 307/10.2 |
| 5,684,407 | 11/1997 | Zdanys, Jr. et al. | 338/184 |

*Primary Examiner*—Richard T. Elms
*Attorney, Agent, or Firm*—David L. Newman

[57] ABSTRACT

An electronic switch having a printed circuit board mounted therein is formed via insert molding of the housing around the printed circuit board enclosing the conductor wires attached to the printed circuit board and resistors attached to the printed circuit board within the insert molded housing. The electronic switch includes a rotor attached to a contact member providing for the circuit connection.

15 Claims, 1 Drawing Sheet

ELECTRONIC SWITCH WITH INSERT MOLDING AND METHOD OF MANUFACTURING SAME

BACKGROUND OF THE INVENTION

The present invention pertains to an electronic switch and, in particular, an electronic switch with insert molding.

Many electrical connectors are known having multiple parts mounted in a housing in order to provide for the functioning of the electrical connector, such as for the turning on and off of the switch. Such electrical connectors commonly have mounted within the housing, printed circuit boards, resistors, conductors and electrical cables. All of these components generally require hand or machine assembly that require time-consuming assembly processes. Some of these electrical connectors are assembled to be water-resistant and need additional components such as rubber plugs surrounding the entrance and exit portions of the housing of the electrical connector in order to ensure water resistance. As electrical connectors become more miniaturized, such assembly processes can become very difficult and labor intensive. Therefore, it is an object of the present invention to provide an electrical connector that may be quickly and easily assembled by combining assembly steps in order to reduce the number of components required for the electrical connector and the time of assembly.

It is another object of the present invention to provide an electrical connector having a water resistant housing.

It is a further object of the present invention to provide a method of assembling an electrical connector that allows for the combination of assembly steps in order to reduce the assembly time for the connector.

SUMMARY OF THE INVENTION

In accordance with the above object of the present invention, an electronic switch is provided having a printed circuit board having a conductive area connected to a conductor mounted to the printed circuit board and a housing insert molded around the printed circuit board and the conductor wire. The printed circuit board may include a resistor mounted thereon and sealed within the injection molded housing. The housing may be molded around the printed circuit board forming an open chamber exposing areas of the printed circuit board having the conductive area thereon and for receiving a contact member mounted onto the conductive area. The contact member may be attached to a rotor mounted within the chamber of the housing and the rotor including a keyed aperture. The housing may be formed to include a cylindrical chamber upon which the rotor may rotate so that the contact member may slide against the conductive area in order to provide for the opening and closing of the electrical circuit.

A method of assembling an electrical connector is provided comprising the steps of assembling a printed circuit board having a conductive area adhered thereto and a conductor wire mounted to the printed circuit board and connected to the circuitized areas, injection molding a housing around the printed circuit board in order to seal the conductor wire within the housing and leave an open chamber on the printed circuit board in order to provide for the conductive areas to be exposed. A contact member may be mounted within the chamber of the housing and a rotor mounted to the contact member wherein rotation of the rotor will cause the contact member to open and close the electrical circuit. The method of assembling the electrical connector may include the step of mounting a resistor on the printed circuit board so that the resistors are connected to the conductive area and upon injection molding of the housing around the printed circuit board, the resistor may be sealed therein.

These and other features of the invention are set forth below in the following detailed description of the presently preferred embodiments.

DETAILED DESCRIPTION OF THE PRESENTLY PREFERRED EMBODIMENTS

Figure 1:
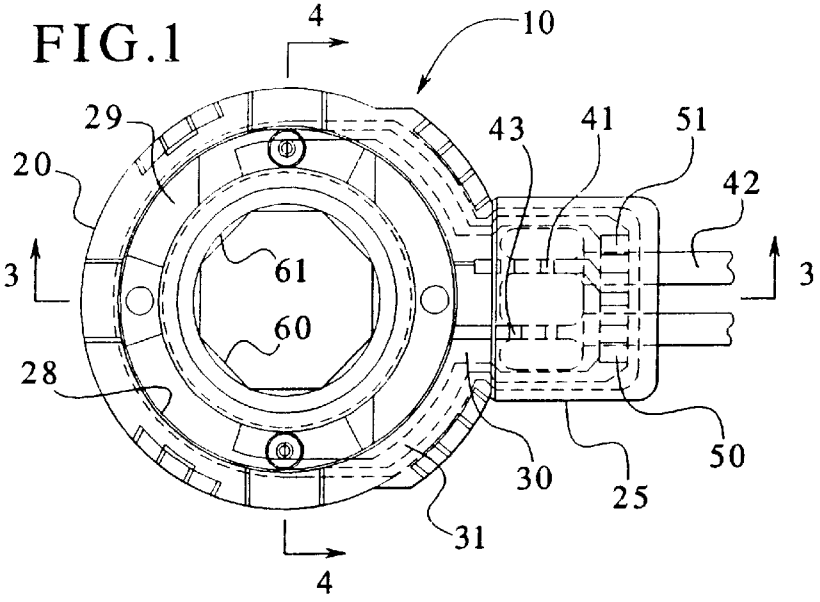
FIG. 1 is a plan view of the electronic switch of the present invention.

The present invention is best understood with reference to FIGS. 1–4. Referring to FIG. 1, the electronic switch 10 is shown having housing 20 having a generally cylindrical shape having an arm 25 protruding from one side of the housing 20. The housing 20 is injection molded of a polymer material such as MINLON brand nylon. The housing 20 is insert molded around the outer perimeter of the printed circuit board 30. Adhered to the circuit board are conductive traces 31 that are connected to conductive areas 32,33 and 34 (see FIG. 2) on the printed circuit board 30. Mounted on the printed circuit board are conductor wires 41,43 which, in a preferred embodiment are copper electrical wiring being stripped at a first end and at a second end covered in a protective sheath 42. In a preferred embodiment, a pair of conductors 41,43 are mounted to the printed circuit board 30 and connected to the conductive traces 31. The housing 20 is then insert molded around the printed circuit board 30 and over the conductors 41,43. Also mounted on the printed circuit board are resistors 50,51. In a preferred embodiment, the resistors are discrete resistor chips such as resistors having a resistance value of 2000 ohms and 470 ohms. These resistors are surface mounted to solder pads on the PCB and secured by reflow soldering. The housing 20 in insert molded forming a chamber 28 which exposes the conductive areas of the printed circuit board. Mounted over the chamber 28 is a rotor 60. The rotor is cylindrical-shaped and has a keyed aperture 61. In a preferred embodiment, the aperture 61 is octagonal-shaped. Attached to the rotor 60 is a contact member 70 which is sandwiched between the rotor 60 and the conductive areas 32,33 and 34 on the printed circuit board and upon rotation of the rotor 60, the contact member will slide in order to provide for the opening or closing of the electrical connection of the electronic switch 10. A cover 29 is mounted on the housing 20 in order to protect and lock the rotor 60 and contact member 70 within the housing 20.

Figure 2:
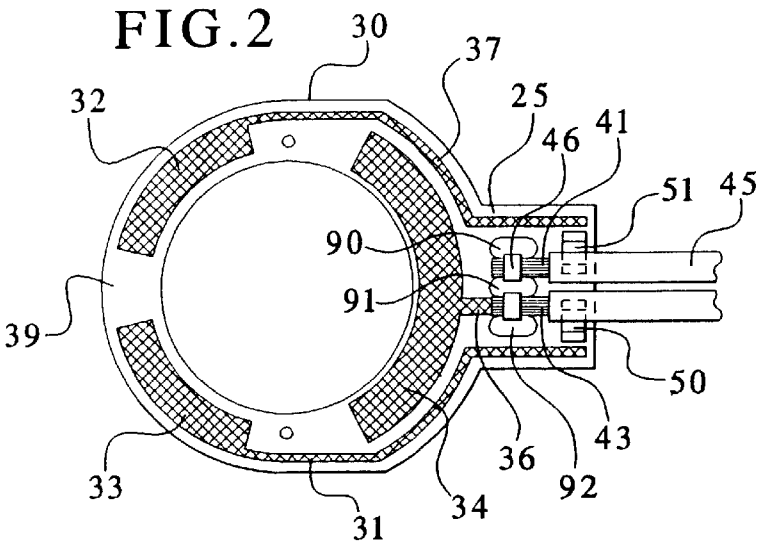
FIG. 2 is a plan view of a printed circuit board of the present invention prior to the insert molding of the housing thereon.

FIG. 2 is a plan view of the printed circuit board 30 prior to assembly with the housing 20 of FIG. 1. The printed circuit board in a preferred embodiment is a planar substrate formed of a material such as FR4. Adhered to the surface are conductive areas 32,33 and 34. In a preferred embodiment, the conductive areas 32,33 and 34 are copper plating. However, any conductive areas such as conductive inks may be adhered to the printed circuit board 30. Also, the printed circuit board may be two-sided and have conductive area on both sides of the printed circuit board 30. The conductive areas 32,33 and 34 have conductive traces 31,36 and 37 attached thereto. For example, conductive trace 31 is connected to conductive area 33 and connects it to the resistor 50. Conductive area 34 is connected to conductive trace 36 which is connected to conductor 43 of the cable 45. It may be understood that when a contact member is rotatably mounted on the circuit board 30, the rotation of the contact to the "on" position will cause conductive areas 32 and 33 to be electrically connected to conductive area 34 in order to close the circuit and allow for the electrical current to flow from the conductor 43 to conductor 41. These conductive areas 32, 33 and 34 are exposed after the housing is injection molded by the formation of chamber 28 so that the circuit board 30 is exposed on the top side having the conductive areas 32,33 and 34.

In a preferred embodiment, the method of assembling the electronic switch 10 occurs according to the following initial steps. The printed circuit board 30 is manufactured having the conductive areas 32,33 and 34 and the conductive traces 31,36 adhered thereto via any known process. The resistors 50,51 are attached to the printed circuit board and connected to the conductive traces 31,37, respectively. The conductor wires 41,43 are mounted to the printed circuit board 30 by any known attachment means. In a preferred embodiment, a crimp sleeve 46 attaches the conductor 41 to the printed circuit board by crimping the wire and formed through holes 90,92 and 92 to the underside of the printed circuit board. The assembly as shown in FIG. 2 is then inserted in a mold cavity and the housing is injection molded around the edges 39 of the printed circuit board 30 and the rectangular arm portion 25 extending off of the circular portion of the printed circuit board. The injection molded material completely encloses the conductors 41,43 and the resistors 50,51 and captures the cables 45 so that a sealed housing is formed.

Figure 3:
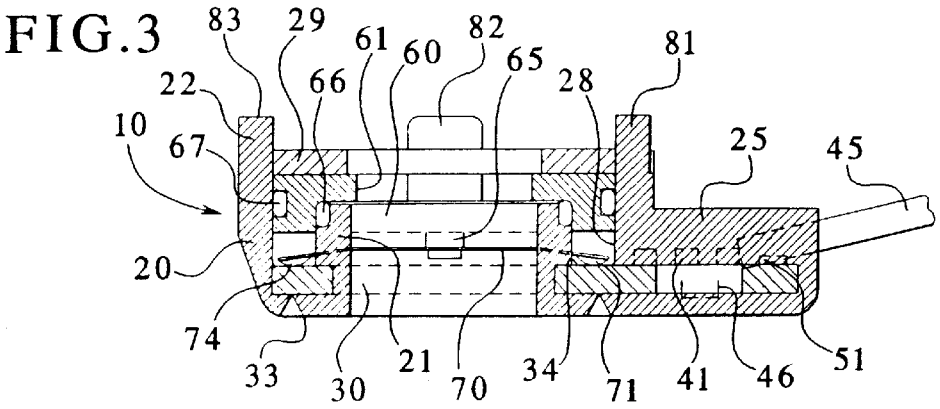
FIG. 3 is a side elevation cut-away view of FIG. 1 taken at line 3—3.

Turning to FIG. 3, the electronic switch 10 is shown fully assembled after the injection molding of the housing 20 around the printed circuit board 30. The conductor wire 41 is shown mounted to the printed circuit board 30 via crimp sleeve 46 and the conductor wire 41 is completely sealed in the injection molded arm area 25 which also captures the cable 45. A disc-shaped contact member 70 includes contact arm 71 that abuts against conductive area 34. Opposite to the contact arm 71 is contact arm 74. When the contact member 70 is oriented in the "on" position, the contact arm 74 abuts against contact area 33 in order to close the circuit and allow for the electrical current to run from one conductor wire 41 to the next conductor wire 43. Resistor 51 is mounted to the circuit board 30 and is completely enclosed in the polymer material injection molded around the printed circuit board 30. In a preferred embodiment, the resistor 51 is attached to the printed circuit board 30 using a solder having a high reflow temperature. The reflow temperature of the solder, in a preferred embodiment, is higher than the temperature of the injection molded material which is molded around the printed circuit board, so that during the insert molding process reflow of the solder does not occur and the resistor does not change its position. In addition, the resistive nature of the resistor should be unaffected by the high temperature of the injection molded material. In an alternate embodiment, a thick-film polymer resistor may be adhered directly to the printed circuit board where the resistive nature of the resistor will not be altered by the temperatures of the injection molding.

A rotor 60 is mounted within the chamber 28 of the housing 20 and the rotor 60 is connected to the contact member 70 via pin 65 protruding through a hole in the contact member 70. The rotor 60 is suspended above the inner diameter collar 21 of the housing 20 by O-ring 66 and against the outer diameter collar 22 of the housing 20 by O-ring 67. The rotor has an inner aperture 61 having a keyed opening so that the insertion of a member within the electrical connector 10 will cause the rotor 60 to rotate and in turn cause the contact member 70 to rotate and move contact arms 71,74 into an "on" or "off" position. In an embodiment, the present electronic switch may be used as a disarm switch in an automobile. The electronic switch 10 mounts behind the key receiving lock mechanism in an automobile door. By rotating the key in the lock, the lock mechanism includes a protruding member mating with the keyed aperture 61 of the rotor of the electrical connector 10. Upon rotation of a key in the automobile door lock, the electronic switch 10 will cause the alarm system to arm or disarm according to the position of the contact member 70. A cover 29 having an aperture of a diameter greater than the rotor diameter is mounted onto the housing and is snapped into position by teeth 81,82 and 83.

Figure 4:
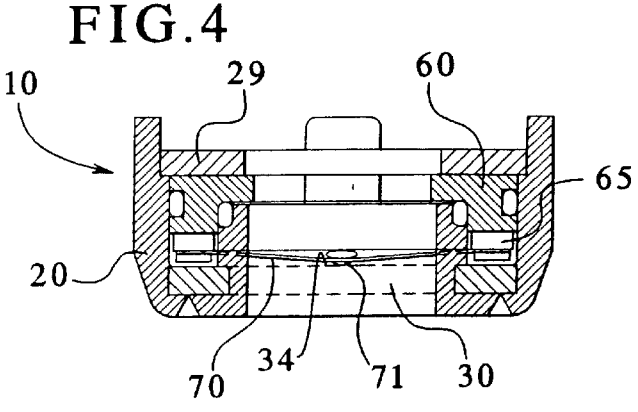
FIG. 4 is a side elevation cut-away view of FIG. 1 taken at line 4—4.

Turning to FIG. 4, an end cut-away view of the electronic switch 10 is shown having the printed circuit board 30 with the insert molded housing 20 surrounding the printed circuit board 30. The disc-shaped contact member 70 includes contact arm 71 abutting against conductor area 34 and attached to the rotor 60 via pins 65 so that upon rotation of the rotor 60, the pin 65 bear against the holes in the contact member 70 and cause the contact member 70 to rotate and to brush the contact arm 71 against the conductive area 34 of printed circuit board 30 and to cause a connect or disconnect position of the electronic switch 10. Therefore, it can be understood that the electronic switch 10 is assembled after the housing is injection molded over the printed circuit board 30 by attaching the contact member 20 to the rotor having the O-rings mounted thereto and mounting the rotor within the chamber 28 of the housing. The cover 29 is then snapped onto the top of the housing 20 and the assembly is complete. In this way, a water resistant housing is formed having the cables, resistors and conductors securely attached to the housing and protected by the molded material of the insert molded housing. Therefore, it may be understood that due to the injection molding of the housing 20 over the printed circuit board 30, the time in this assembly is greatly reduced and the electrical connector is a strong water-tight unit.

It should be understood that various changes and modifications to the presently preferred embodiments described herein will be apparent to those skilled in the art. Such changes and modifications may be made without departing from the spirit and scope of the present invention and without diminishing its attendant advantages. For example, the switch may have a blind hole where the lock projection will not go through the entire width of the switch and only one o-ring is needed for the rotor. In addition, the switch may include a torsion spring attached to the rotor in order to provide for a return means of the switch. It is, therefore, intended that such changes and modifications be covered by the appended claims.

What is claimed is:

1. An electronic switch comprising:

a printed circuit board having a conductive area thereon and connected to a conductor wire attached to the printed circuit board;

a housing insert molded around the printed circuit board having an open chamber exposing the conductive area of the printed circuit board; and a contact member mounted in the housing in order to open and close a circuit.

2. The electronic switch of claim 1 wherein the housing encloses the outer perimeter of the printed circuit board.

3. The electronic switch of claim 1 wherein a rotor is mounted within the chamber of the housing and attached to the contact member.

4. The electronic switch of claim 3 wherein the rotor includes a keyed aperture for receiving a member having a corresponding outer perimeter to the keyed aperture, wherein rotation of the member causes the rotor to rotate and move the contact member in order to open and close the circuit.

5. The electronic switch of claim 1 wherein the conductor wire is completely surrounded by molded material of the insert molded housing in order to provide a water-proof barrier around the conductor wire.

6. The electronic switch of claim 1 wherein a resistor is mounted on the printed circuit board and upon insert molding of the housing around the printed circuit board, the resistor is completely enclosed by injection molded material.

7. The electronic switch of claim 1 wherein the housing forms a cylindrical-shaped member having an open cylindrical chamber for receiving a disk-shaped rotor and disk-shaped contact member.

8. The electronic switch of claim 1 wherein the electronic switch is a disarm switch for an automobile.

9. A method of assembling an electronic switch comprising the steps of:

forming a printed circuit board having a conductive area thereon;

attaching a conductor wire to the printed circuit board;

mounting the printed circuit board within a mold cavity;

insert molding a housing around the printed circuit board forming an open chamber within the housing and exposing the conductive area; and mounting a contact member within the chamber onto the printed circuit board and the contact member attached to a rotor, which is mounted within the chamber of the housing.

10. The method of claim 9 wherein resistors are mounted onto the printed circuit board prior to the insert molding of the housing thereon.

11. The method of claim 9 wherein the conductive area is adhered to the printed circuit board via a subtractive copper-plating method.

12. The method of claim 9 wherein the conductive area is adhered to the printed circuit board via an additive process using conductive inks.

13. The method of claim 9 wherein the conductive wires are mounted to the printed circuit board by using crimp sleeves to mechanically attach the conductor wires to the printed circuit board.

14. The method of claim 9 wherein a resistor is mounted to the printed circuit board using surface mount soldering methods.

15. The method of claim 9 wherein a resistor is attached to the printed circuit board via screen printing thick film polymer inks.

* * * * *